United States Patent [19]

Cole

[11] Patent Number: 4,909,930

[45] Date of Patent: Mar. 20, 1990

[54] FOREIGN OBJECT SEPARATION APPARATUS

[75] Inventor: Michael Cole, Andover, United Kingdom

[73] Assignee: GBE International Plc, Andover, United Kingdom

[21] Appl. No.: 215,068

[22] PCT Filed: Oct. 29, 1987

[86] PCT No.: PCT/GB87/00767

§ 371 Date: Jul. 12, 1988

§ 102(e) Date: Jul. 12, 1988

[87] PCT Pub. No.: WO88/03063

PCT Pub. Date: May 5, 1988

[30] Foreign Application Priority Data

Oct. 30, 1986 [GB] United Kingdom ..... 8625953

[51] Int. Cl.[4] ..... B07C 5/00

[52] U.S. Cl. ..... 209/564; 209/587; 209/639; 209/939

[58] Field of Search ..... 209/564–566, 209/576, 577, 587, 639, 644, 939; 364/555

[56] References Cited

U.S. PATENT DOCUMENTS

| | | | |
|---|---|---|---|
| 3,472,375 | 10/1969 | Mathews | 209/564 X |
| 3,581,888 | 6/1971 | Kelly | 209/587 X |
| 3,977,526 | 8/1976 | Gordon et al. | 209/639 X |
| 4,352,430 | 10/1982 | Maier et al. | 209/581 X |
| 4,561,545 | 12/1985 | Carlow | 209/564 |
| 4,657,144 | 4/1987 | Martin et al. | 209/639 X |

FOREIGN PATENT DOCUMENTS

| | | | |
|---|---|---|---|
| 1560152 | 1/1980 | United Kingdom | 209/587 |

*Primary Examiner*—Donald T. Hajec
*Attorney, Agent, or Firm*—Dowell & Dowell

[57] ABSTRACT

A foreign object separation apparatus which utilizes a camera which views a flow of material being conveyed in order to develop an electronic control signal indicative of the presence of foreign matter within one or more main or overlapping zones which are monitored across the flow of material to thereby control valves which actuate appropriate individual or adjacent fluid nozzles to expel the foreign matter from the material being conveyed.

4 Claims, 3 Drawing Sheets

1/3

FOREIGN OBJECT SEPARATION APPARATUS

BACKGROUND OF THE INVENTION

This invention relates to a foreign object separator including a multi zone detection system, and means for providing a fluid blast controlled by said detection system to remove foreign objects from a single flowing stream of material. In a known apparatus one of a series of fluid valves allocated to a number of detection zones may be operated on detection of a foreign particle. By appropriate timing the valve is actuated at the moment the particle arrives opposite an air blast nozzle connected to the valve.

A problem arises where an object which may be as large as a tag or label, extends beyond a single detection zone since due to the fall-off of air velocity at the zone edges the blast may be insufficient to remove the object. It is known that zone overlap can be provided by mechanical means, but with this fixed overlap a system cannot be easily optimised.

SUMMARY OF THE INVENTION

An object of the invention is to provide an apparatus in which the detection zones may be programmed so that each may overlap an adjacent zone. Furthermore, the zone positions, zone sizes and the extent of overlap may be determined.

According to the invention there is provided a foreign object separation apparatus comprising a feed conveyor for delivering material to be processed to an inspection region where the material descends, means for illuminating the material in the inspection region, a plurality of fluid blast nozzles, a plurality of solenoid controlled valves connected respectively to said nozzles, a camera for scanning the material descending in the inspection region, a background compensation and video comparator connected to said camera to receive pixel data therefrom, a reject position decoder for receiving reject data from the comparator, a programmable zone boundary decoder, the outputs of said reject position decoder and said boundary decoder being synchronized by clock signals outputed by said camera, and a zone decoder logic circuit connected to the outputs of said reject position decoder and said boundary decoder to produce outputs signals which actuate said solenoid controlled valves, said zone decoder logic circuit being programmable so that when a reject data signal from said comparator representing a position falling wholly within a main zone but outside an overlap zone is decoded in the zone decoder logic circuit the corresponding valve only will be actuated, whereas when a reject data signal from said comparator representing a position falling wholly or partly within a main zone and also wholly or partly within an overlap zone is decoded in the zone decoder logic, the valves controlling the nozzle on each side of the reject position will be actuated.

BRIEF DESCRIPTION OF THE DRAWINGS

The invention will now be described by way of example with reference to the accompanying drawing in which.

DESCRIPTION OF THE PREFERRED EMBODIMENT

Figure 1:
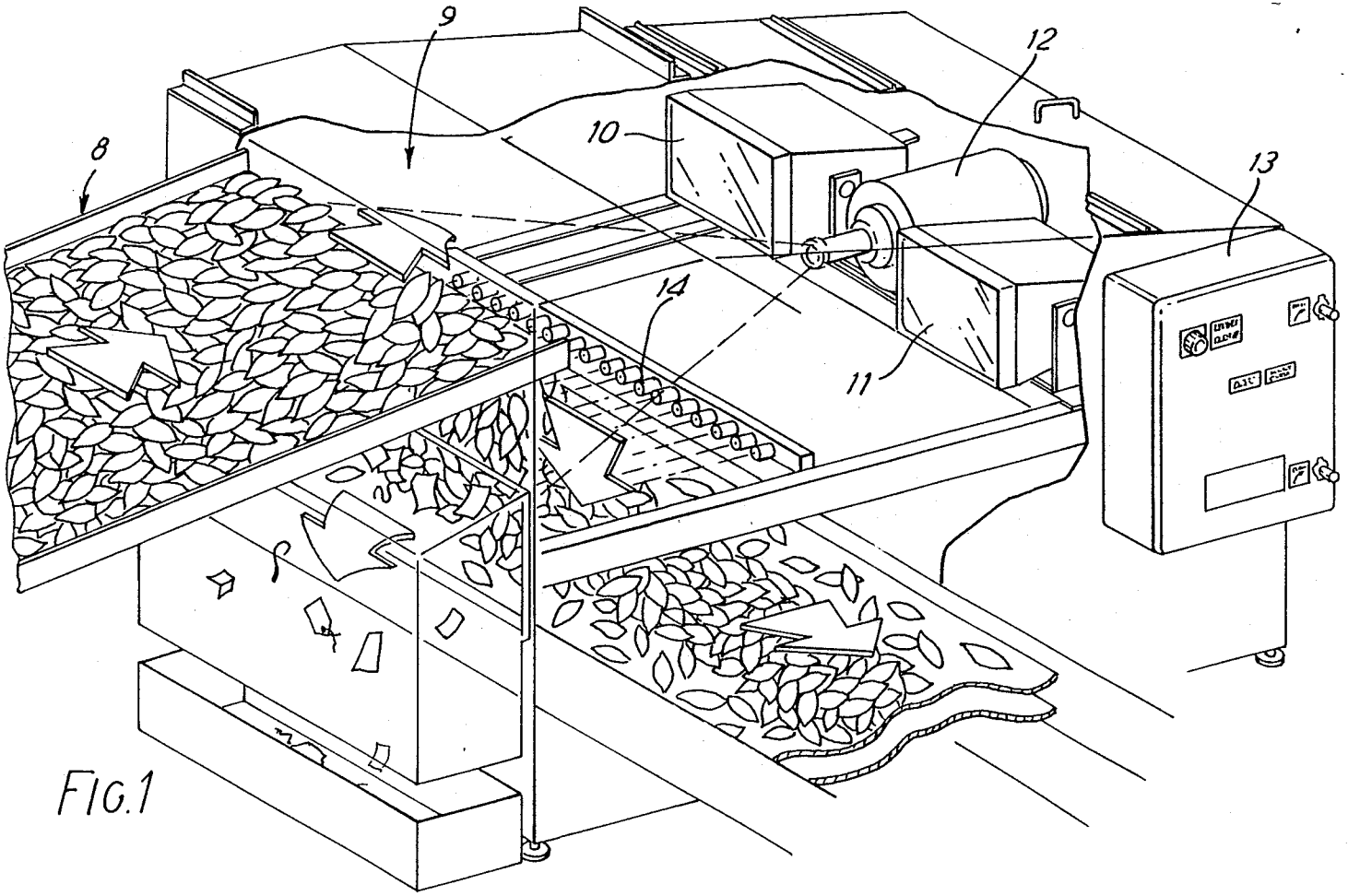
FIG. 1 is a perspective view of the apparatus with the cover broken away.

The separator system of the present invention comprises an optical pneumatic system comprising a feed conveyor 8 for delivering tobacco to an inspection region 9 where the tobacco descends, lamps 10, 11 which provide a high level of illumination (13,000 LUX), a 1024 element solid state camera 12, a control interface cubicle 13, and a solenoid operated pneumatic reject assembly shown generally at 14.

Figure 4:
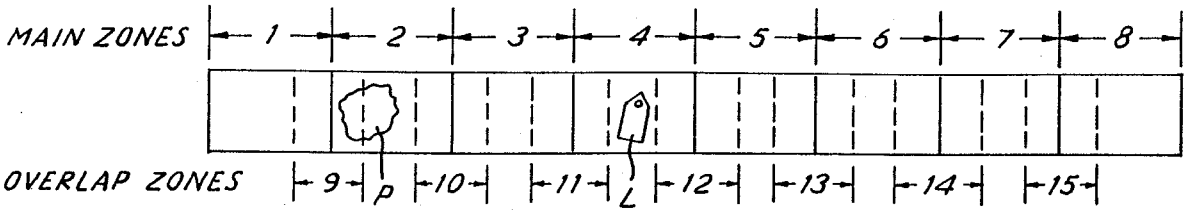
FIG. 4 is a schematic diagram showing main zones and overlap zones covered by the camera.
Figure 3:
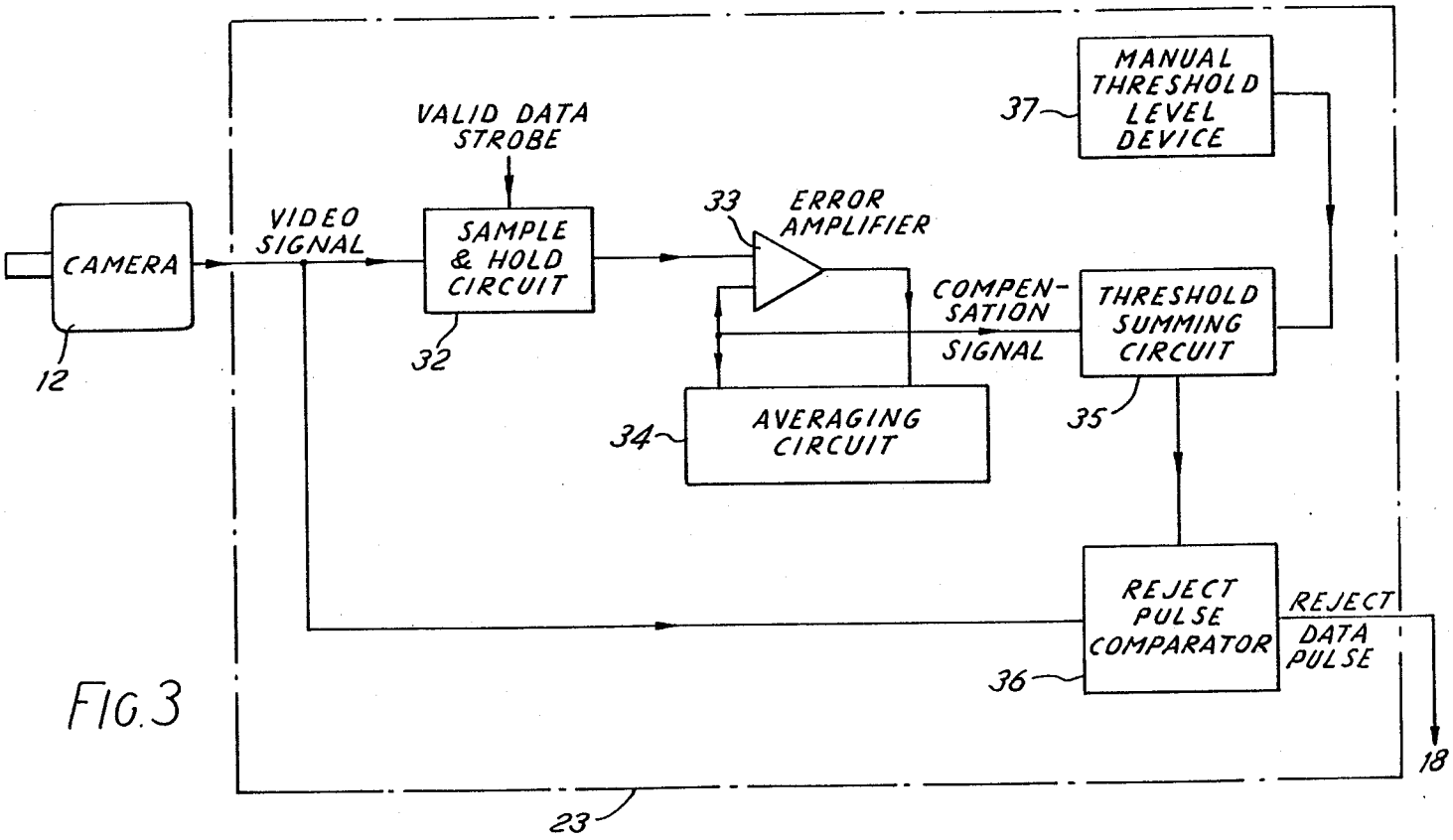
FIG. 3 is a circuit of a background compensation and video comparator.

The camera view is separated electronically into eight main (1–8) zones and seven overlap zones (9–15), each main zone being 128 mm wide, and each overlap zone being 42 mm wide (see FIG. 4).

In operation the camera views a horizontal strip 1 mm by 1 meter, this view is converted by a lens, filter, and CCD assembly into a quantity of electrical charge. The quantity of charge is proportional to the reflectance of the object in view, and its spectral position, the charge being accumulated, amplified and transmitted from the camera as video data 1000 times a second.

Figure 2:
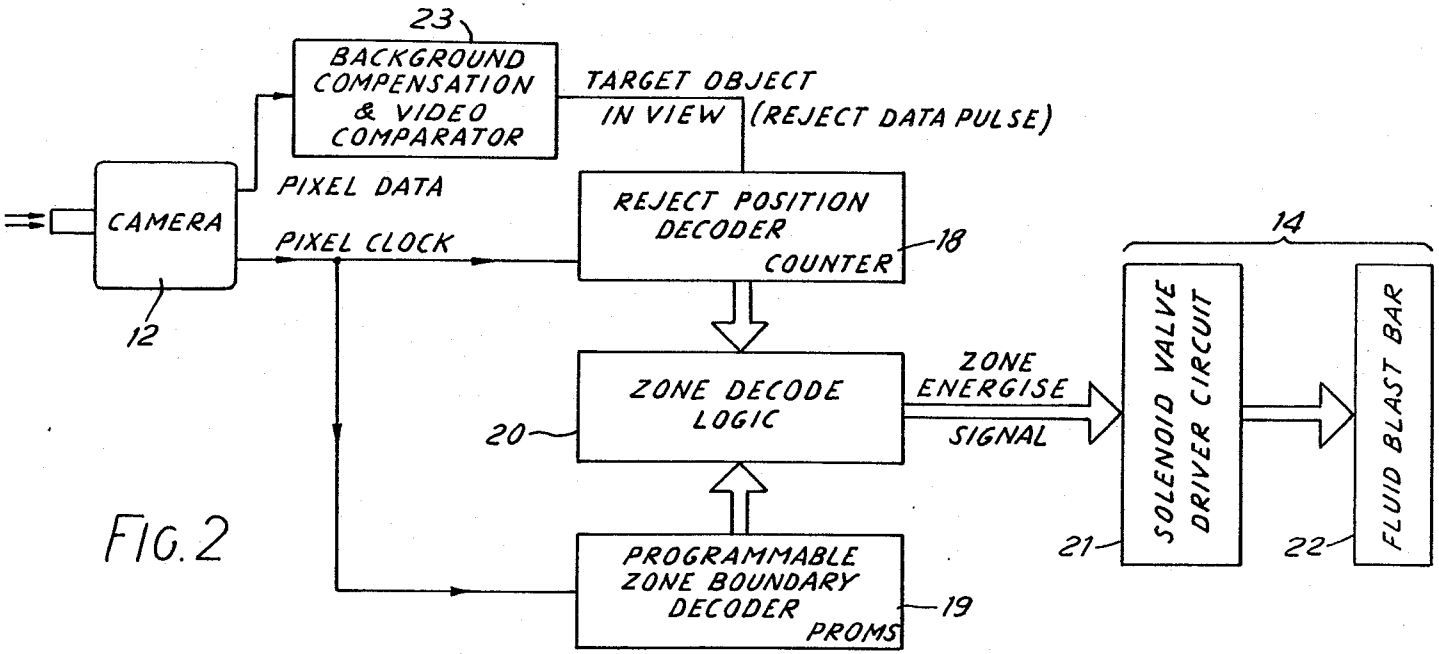
FIG. 2 is a block diagram of the apparatus.

The apparatus shown in FIG. 2 comprises a decoder 18 which receives reject data from the camera 12 via a video comparator 23. A pixel clock is also output from camera 12 to synchronise the reject position decoder 18 with a programmable zone boundary decoder 19, the synchronised outputs from the reject position decoder 18 and the zone boundary decoder 19 being combined in the zone decoder logic 20. The output from the zone decode logic providing signals for the solenoid operated pneumatic reject assembly comprising a valve driver circuit 21 to feed fluid blast bars 22. If the total number of actuator valves is N then the number of main zones will also be N and the number of overlap zones will be N−1.

The video comparator 23 may be of a kind described in copending United Kingdom Patent application No. 8625954 in which the video signal from the camera 12 is held by the valid data strobe in sample/hold device 32. The output of the sample/hold is compared with the output of an averaging circuit 34 (e.g. 1.5 minutes) to produce an error signal at the output of an amplifier 33. This error signal is used to modify the current value of the averaging circuit 34. A signal from a manual threshold level device 37 is summed together with the compensating signal at the output of the 1.5 minute averaging circuit 34, in a threshold summing circuit 35. The resultant output is compared with the video signal in a reject pulse comparator 36. If the video signal is greater than the summed threshold signal a reject data pulse will be output from the comparator 36.

The schematic drawing of FIG. 4 shows an eight zone system, although any number of zones could be used, with the main zones numbered one to eight, and the overlap zones numbered nine to fifteen.

When a reject data signal from the video comparator 23 representing a position of an object (e.g. label L) falling wholly within a main zone (4) but outside an overlap zone (11 and 12) is decoded in the zone decoder logic 20, the corresponding valve only will be actuated to operate one or a group of nozzles.

When a reject data signal from the video comparator 23, representing a position of an object (e.g. a piece of paper P), falling within a main zone (2) and also inside an overlap zone (9) is decoded in the zone decoder logic the two valves on each side of the reject position will be actuated to operated one or a group of nozzles.

By "overlap zone" is meant a part superimposed onto adjacent main zones, so that both main zones may be energised (valve open) if a particle is detected within an overlap zone.

The programmable zone boundary decoder 19 uses standard memory devices to hold look-up tables corresponding to the parameters of the zone position, zone size, overlap position and overlap size, said parameters all being variable. For dynamic programmability read/-write memory devices may be used.

I claim:

1. A foreign object separation apparatus comprising a feed conveyor (8) for delivering material to be processed to an inspection region where the material descends, means (10, 11) for illuminating the material in the inspection region, a plurality of fluid blast nozzles (22), a plurality of solenoid controlled valves (21) connected respectively to said nozzles, a camera (12) for scanning the material descending in the inspection region, said camera having a view which is separated electronically into a plurality of main zones and a plurality of overlap zones which are smaller than said main zones, each of said overlap zones covering a portion of two adjacent of said main zones, each of said main zones corresponding to separate solenoid controlled valves, a background compensation and video comparator (23) connected to said camera to receive pixel data therefrom, said comparator developing a reject data signal to indicate the presence of foreign material within one or more of said main and overlap zones, a reject position decoder (18) for receiving said reject data signal from the comparator, a programmable zone boundary decoder (19), the outputs of said reject position decoder (18) and said boundary decoder (19) being synchronized by clock signals outputed by said camera, and a zone decoder logic circuit (20) connected to the outputs of said reject position decoder (18) and said boundary decoder to produce output signals which actuate said solenoid controlled valves, said zone decoder logic circuit (20) being programmable so that when a reject data signal from said comparator (23) which represents that foreign material is wholly within a main zone but outside an overlap zone is decoded in the zone decoder logic circuit, the corresponding solenoid controlled valve for such main zone only will be actuated, whereas when a reject data signal from said comparator which represents that foreign material is wholly or partly within a main zone, and also wholly or partly within an overlap zone is decoded in the zone decoder logic, the solenoid controlled valves (21) controlling the nozzles (22) corresponding to the solenoid controlled valve for such main zone and the adjacent main zone will be actuated.

2. A foreign object separation apparatus as claimed in claim 1, characterized in that the programmable zone boundary decoder (19) is provided with memory devices to hold look-up tables corresponding to the parameters of the main zone position, main zone size, overlap position and overlap size.

3. A foreign object separation apparatus as claimed in claim 2, characterized in that the memory devices comprise read/write devices for dynamic programmability.

4. A foreign object separation apparatus as claimed in claim 1, 2 or 3, characterized in that the video comparator (23) comprises a sample and hold device (32) controlled by a valid data strobe, an averaging circuit (34), an error amplifier between said sample and hold device and said averaging circuit, a threshold summing circuit (35) having a first input to receive a compensation signal, a threshold level control device (37) connected to a second input of said threshold summing circuit, and a reject pulse comparator (36), wherein the output signal from said sample and hold device is compared with the output of the averaging circuit to produce a compensation signal which is summed together with the output signal from the threshold level control device, the resultant output therefrom being compared with the video signal in the reject pulse comparator.

* * * * *